FIP8011 XR 4,022,281

United States Patent [19]

Pennock

[11] 4,022,281

[45] May 10, 1977

[54] METHOD AND APPARATUS FOR ORIENTING EQUIPMENT IN A WELL

[75] Inventor: Michael Derek Pennock, Pinner, England

[73] Assignee: The British Petroleum Company Limited, London, England

[22] Filed: Apr. 13, 1976

[21] Appl. No.: 676,529

[30] Foreign Application Priority Data

Apr. 18, 1975 United Kingdom ..... 16066/75

[52] U.S. Cl. ..... 166/315; 166/250; 166/.5

[51] Int. Cl.[2] ..... E21B 23/00

[58] Field of Search ..... 166/315, 250, .5, .6, 166/237, 75, 77, 240; 251/1 A

[56] References Cited

UNITED STATES PATENTS

| | | | |
|---|---|---|---|
| 3,021,909 | 2/1962 | Postlewaite | 166/315 X |
| 3,279,539 | 10/1966 | Brown et al. | 166/315 X |
| 3,412,789 | 11/1968 | Ralph et al. | 166/.6 |
| 3,690,381 | 9/1972 | Slator et al. | 166/315 |
| 3,835,294 | 9/1974 | Albers et al. | 166/.5 |
| 3,912,014 | 10/1975 | Wetzel | 166/315 |
| 3,955,622 | 5/1976 | Jones | 166/.5 |
| 3,974,875 | 8/1976 | Herd et al. | 166/.5 |

*Primary Examiner*—Stephen J. Novosad
*Attorney, Agent, or Firm*—Morgan, Finnegan, Pine, Foley & Lee

[57] ABSTRACT

An apparatus for installation in a drill string to orientate equipment in or below an underwater blow out preventer has an elongate member to be corrected in the drill string and having thereon a second member moveable axially with respect thereto but having means to prevent relative rotation, the second member having a surface adapted for engagement with the rams of the blow out preventer.

8 Claims, 9 Drawing Figures

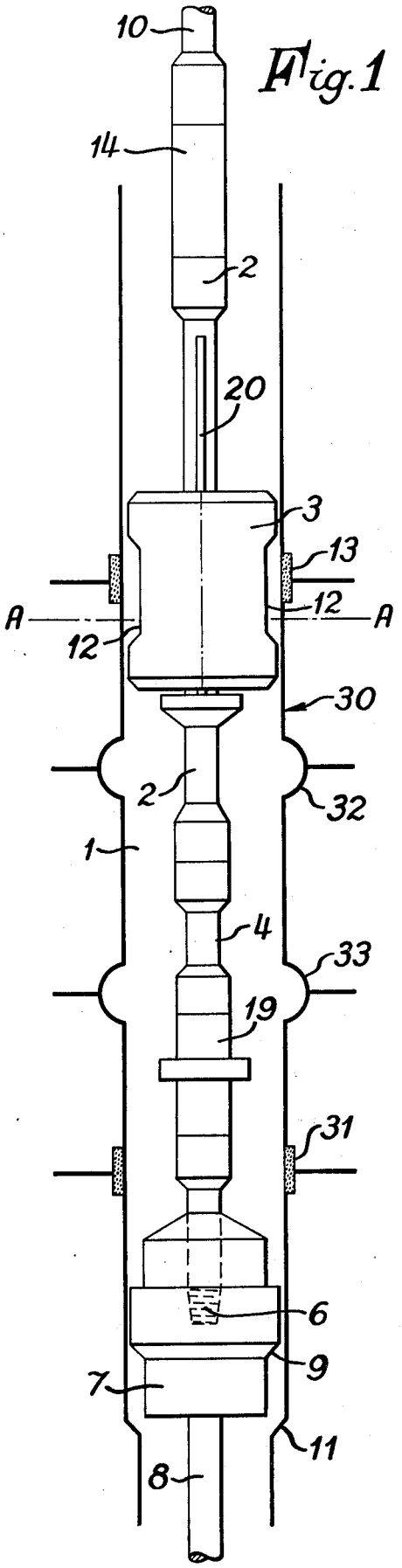
Fig. 1
Fig. 2
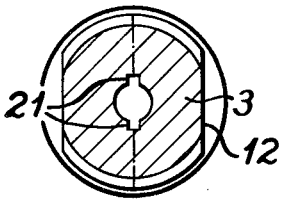
Fig. 8A
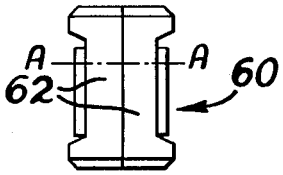
Fig. 8B
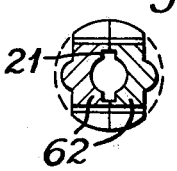

METHOD AND APPARATUS FOR ORIENTING EQUIPMENT IN A WELL

This invention relates to an apparatus and a method for orientating equipment in or below a blow out preventer stack (hereafter referred to as B.O.P. stack).

A method which has been previously used for orientating equipment in or below a B.O.P. stack involves the positioning of a vertical member such as a lug or slot in relation to some part of either the B.O.P. stack or its adjacent members. Usually a special orientation member is involved which either has to be installed and orientated before installing the B.O.P. stack, or the B.O.P. stack has to be removed to allow the orientation member to be installed. The equipment to be installed and orientated e.g. a tubing hanger has a member such as a lug to engage the orientation member. Alternatively the member can be provided on an installation tool which is attached to the equipment to be orientated.

Previously, a heavy duty bearing has sometimes been employed in the equipment to support the weight of tubulars and tools (e.g. 10,000 feet of tubulars weighing 150,00 lbs) during the rotation by the handling string to obtain fine orientation prior to landing. The arrangement has the disadvantage of severe space limitations and is also not recovered.

It is an object of the present invention to provide an improved apparatus and method for orientating equipment in or below a B.O.P. stack.

According to the present invention an apparatus for installation in a handling string to orientate equipment by means of rams of a B.O.P. stack comprises:- an elongate member adapted to be connected in a handling string, the elongate member having a second member thereon which second member is moveable axially with respect to the elongate member and has means co-operating with corresponding means on the elongate member to prevent relative rotation, the second member also having a surface adapted for engagement with the rams of a B.O.P. stack so that when the rams of the B.O.P. stack are actuated they engage the surface of the second member and rotation of the second member relative to the B.O.P. stack is prevented.

The term "orientate" is well known in the art meaning to controllably adjust and/or maintain the angular disposition of a member.

Conveniently the elongate member is a mandrel of substantially tubular form. Preferably the means co-operating with corresponding means on the second member is a spline or splines co-operating with a slot in the second member or vice versa.

Preferably the spline runs parallel to the axis of the mandrel.

Preferably the mandrel has an enlarged portion towards each end of the part covered by the movement of the second member to provide stops to limit the movement.

Preferably the second member is in the form of a block conveniently made in the form of two halves for ease of assembly which, when put together, meet in a plane which in normal use is a vertical plane.

In an alternative embodiment the second member can be in the form of a sleeve.

Preferably the surface of the block is provided with flats to be engaged by the blind rams of a B.O.P. stack at a waisted portion of the block. Preferably the portions above and below the waisted portion are of the same diameter to maintain alignment.

Alternatively the surface of the block is contoured to mate with the tubular rams of a B.O.P. stack, for use when the blind rams are of the shear type.

For eccentric orientation the lower face of the block preferably has a recess therein and the mandrel an enlarged portion, the surface of which corresponds to the contours of the recess.

A sleeve adapted to co-operate with the tubular rams of the B.O.P. stack can be mounted on the mandrel at a position above or below the block.

According to another aspect of the invention an apparatus for installation in a drill string to orientate equipment in or below an underwater B.O.P. stack comprises:

an elongate member adapted to be connected in a handling string, the elongate member having a sleeve adapted for engagement by the tubular rams of a B.O.P. stack, the sleeve being moveable axially with respect to the elongate member but having means to prevent rotation relative thereto.

Preferably the elongate member has a second member which can be a block thereon which block is fixed to the elongate member and immoveable relative thereto.

Preferably the sleeve is disposed below the block.

In a modification the block can be axially moveable relative to the elongate member but has means corresponding with corresponding means on the elongate member to prevent relative rotation.

According to another aspect of the invention a method of orientating equipment in or below a B.O.P. stack comprises:

i. installing in the handling string an apparatus as hereinbefore described ii. lowering the handling string until the equipment is a small distance above a landing point and the second member is adjacent a pair of rams of the B.O.P. stack iii. closing the rams so that they engage the surface on the second member and prevent rotation thereof, and iv. lowering the handling string to land the equipment.

By precise orientation in the present specification is meant orientation to within 1 degree. By coarse orientation is meant orientation to within 10°.

The invention is illustrated with reference to the accompanying drawings in which FIG. 1 is a longitudinal section through a B.O.P. stack showing one form of the invention comprising a tubular member having a slideable block mounted thereon located in the bore of the B.O.P. stack and arranged for concentric orientation.

FIG. 2 is a section taken on the line A—A of FIG. 1.

FIG. 8A is a longitudinal section of a block suitable for use with tubular rams when the B.O.P. has shear type blind rams which prevent the use of a block similar to that shown as item 3 and FIG. 8B is a cross section taken on the line A-A of FIG. 8A.

Figure 3:
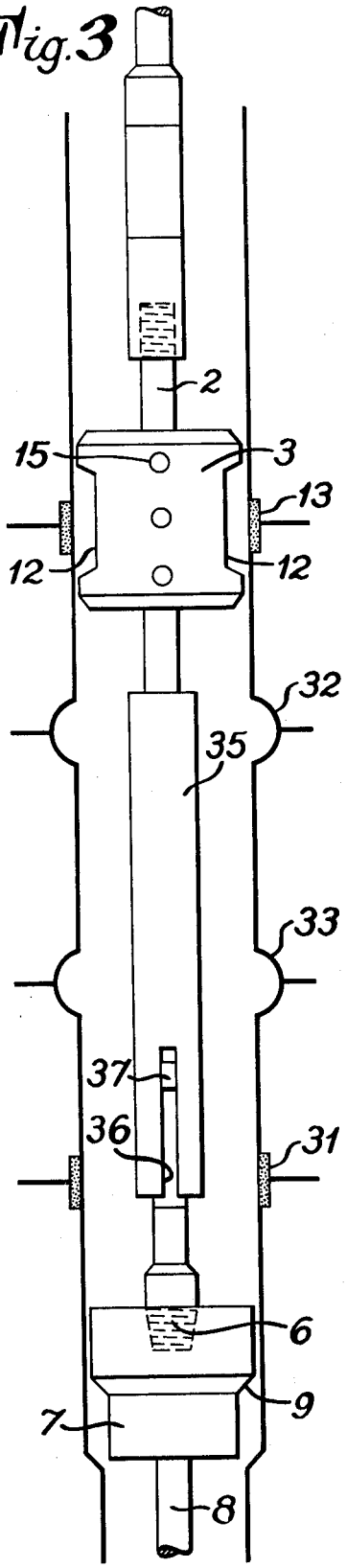
FIG. 3 is a longitudinal section through a B.O.P. stack showing another form of the invention comprising a tubular member having an immoveable block mounted thereon and also comprising a sleeve slideably moveable with respect to the tubular member arranged for concentric orientation.

With reference to FIGS. 1 and 2 of the drawings the apparatus indicated generally by reference numeral 1 comprises a tubular member in the form of a mandrel 2 having a block 3 thereon. The block 3 is axially slideable with respect to the mandrel 2 and has grooves 21 therein engaged by splines 20 on the mandrel to prevent relative rotation. The apparatus is located in a typical B.O.P. stack indicated generally by 30, which B.O.P. stack has two sets of blind rams 13 and 31 and two sets of tubular rams 32 and 33. The lower end of the B.O.P. stack 30 is connected to a landing point 11 in a well head. The block has flats 12 adapted for engagement with rams 13 of the B.O.P. stack to cause the block to rotate if the flats are not aligned with the rams and when the rams and flats are fully engaged to prevent movement (both rotational and axial) of the block relative to the B.O.P. stack 30.

The mandrel 2 is connected at its upper end to a handling string 10 consisting of drill pipe or tubular and, at its lower end to a spacer connection 4, the lower end of which is connected to a member 19 which is in turn connected to a running tool 6 which is connected to a tubing hanger 7 which supports a tubular string 8.

In use for concentric orientation the procedure is as follows: an assembly consisting of the handling string 10, sub 14, mandrel 2, block 3, spacer connection 4, member 19, running tool 6, tubing hanger 7 and tubular string 8 is lowered until the landing shoulder 9 of the tubing hanger 7 is an appropriate distance (to allow for heave and landing stroke) above the landing point 11. The tubing hanger 7 is orientated as desired in relation to the mandrel 2 by spacer connection 4 and member 19 at the surface prior to running. The flats 12 of the block 3 are positioned adjacent the blind rams 13 of the B.O.P. with the flats approximately aligned to the rams 13. A fairly wide angular tolerance of up to 30° for example is permitted. This approximate alignment can be effected by:

i. visual orientation at the surface and subsequent prevention of rotation of the handling string below the rotary table on the surface vessel during make up and lowering of the handling string ii. not fixing the position of the flats on the block during running but on reaching the position adjacent the rams running an orientation instrument on a line into a sub 14 immediately above the mandrel 2 and then rotating the drill string if necessary or iii. orientating during running with coarse orientation sleeve in lower end of a marine riser, if present.

The blind rams are then closed to firmly align the block 3 with the blind rams and the tubing hanger 7 with the B.O.P. stack. This closing of the blind rams effects precise orientation of the block and hence the tubing hanger. The flats 12 where the block 3 is engaged by the rams 13 provide a large area for absorption of the ram load. The mandrel is then stroked down to land, seal and latch the tubing hanger 7, orientation being maintained during the stroke by spline 20 and grooves 21. (The latch and seals are not shown). The running tool 6 can then be released.

The operation just described can be a first step in an underwater well completion, that is to say preparing the well for production after the drilling has been completed.

With reference to FIG. 3 the apparatus comprises a mandrel 2 having a block 3 immoveably mounted thereon by means of fasteners 15. The mandrel 2 is enclosed within a sleeve 35, the sleeve 35 being axially moveable relative to the mandrel and having an axial slot 36 engaged by a lug 37 on the sleeve to prevent relative rotation. The block 3 has flats 12 suitable for engagement by blind rams 13. The outer surface of the sleeve 35 is suitable for engagement by tubular rams 32 or 33.

The apparatus shown in FIG. 3 can be used in a manner similar to that described for the apparatus shown in FIGS. 1 and 2 except that the tubular rams 32 or 33 are employed as well as, or instead of the blind rams 13. Using the tubular rams alone coarse orientation can be achieved and using both tubular rams and blind rams precise orientation can be achieved. In the latter operation, the block 3 is located opposite the blind rams 13 and orientation effected as described above with reference to FIGS. 1 and 2. The upper or lower tubular rams are then closed on the sleeve 35 and the blind rams 13 opened.

The mandrel is then lowered and orientation is maintained by means of the lug 37 in slot 36 during the vertical travel. The tubing hanger 7 is then landed and latched as required. The tubular rams are then opened.

Figure 4:
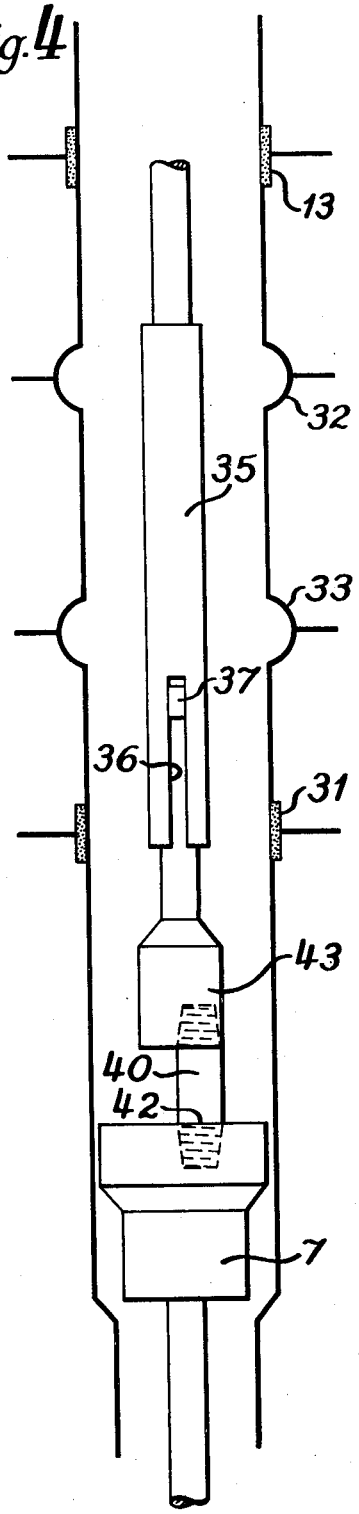
FIG. 4 is a longitudinal section through a B.O.P. stack showing another form of the invention comprising a tubular member having a moveable sleeve mounted thereon arranged for coarse eccentric orientation.

FIG. 4 is a longitudinal section of further embodiment of the invention in which the block 3 is omitted and the lower end of the mandrel 2 has an enlarged portion 43 having in its lower face a screw threaded recess to receive an adapter 40. The apparatus is otherwise generally similar to that shown in FIG. 3. The apparatus is located in a B.O.P. stack in the coarse orientation of an eccentric tubing hanger. The upper portion 42 of the tubing hanger is eccentric and connected to the lower end of the mandrel by an adapter 40. In use the drill string is coarsely orientated from the surface as described above by visual means and the tubular rams closed. The string is then lowered and orientation maintained as described above with reference to FIG. 3.

Figure 5:
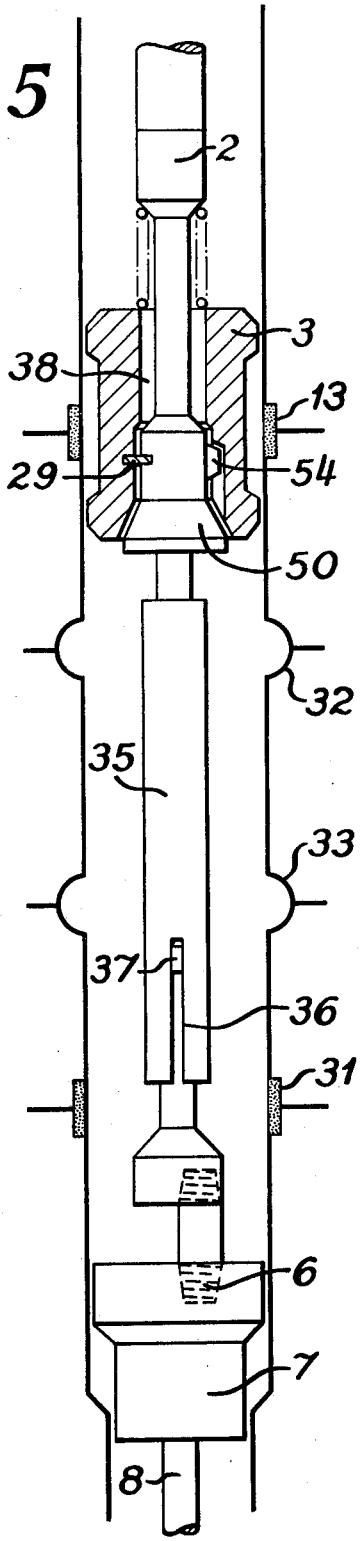
FIG. 5 is a longitudinal section through a B.O.P. stack showing another form of the invention comprising a tubular member, a relatively moveable block and a moveable sleeve arranged for fine eccentric orientation.

FIG. 5 is a longitudinal section of a further embodiment of the invention which can be used for precise orientation of an eccentric tubing hanger. The apparatus below the level of the tubular rams 32 is similar to that described above with reference to FIG. 4. The block is in two halves which define space 38 (to permit eccentric rotation when disengaging). The mandrel has an enlarged portion 50 whose upper surface corresponds with the corresponding mating surface of the block. The enlarged portion 50 is held to the block 3 during the initial part of the running by a pin 29, and key 54 engaging an axial slot in the block. In use the approximate orientation is ascertained as described above with reference to FIG. 1 and the blind rams 13 closed on the block 3. On lowering, an inner section of mandrel 2 moves down and shears the pin 29. The mandrel has a key 54 to maintain rotational alignment whilst running the whole assembly down when the blind rams 13 are initially closed and before the tubular rams are closed. The tubular rams 32 or 33 are then closed on the sleeve 35. When the mandrel moves down, space becomes available between the mandrel and the block 3 for allowing subsequent eccentric rotation when disengaging. After landing, the tubular rams 32 or 33 and blind rams 13 are opened and the string can be rotated as necessary. The block 3 forms a restraint to limit gyrations when orbitally rotating the string for eccentric release.

Figure 6:
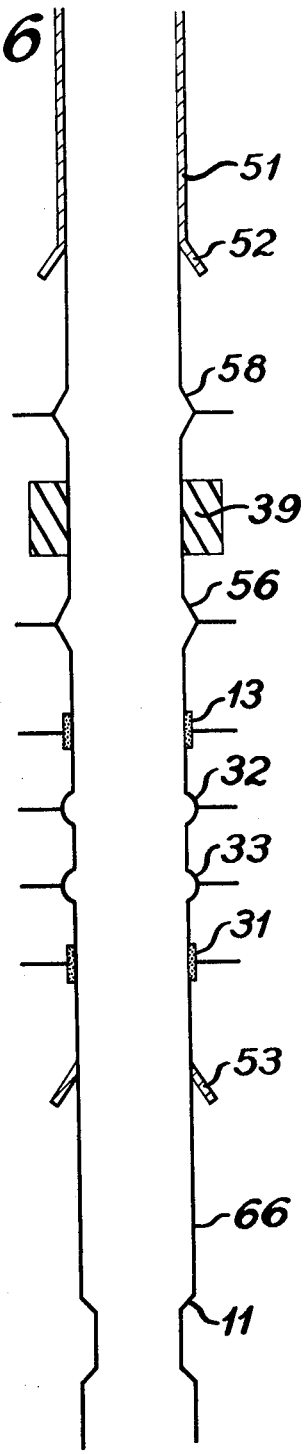
FIG. 6 is a longitudinal section of a portion of an offshore oil well showing a B.O.P. stack interposed between a well head section and a marine riser section.

FIG. 6 is a longitudinal section of a portion of an offshore well showing a B.O.P. stack in position between a marine riser section 51 and a well section 66. The B.O.P stack is connected to the well head section 66 at connector 53. Included in the B.O.P. stack is a lower annular type connector 56 above which is an upper annular connector 58. Typical ram dispostions 13, 31, 32, 33 are shown.

Figure 7:
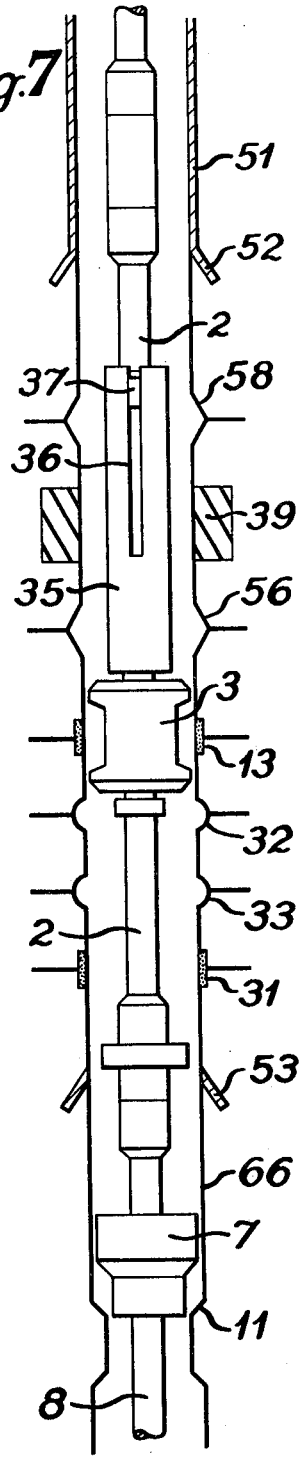
FIG. 7 is a longitudinal section of a typical B.O.P. stack showing another form of the invention comprising a sleeve disposed above a block arranged for fine orientation in which an annular type B.O.P. is used.

FIG. 7 is a longitudinal section of a typical B.O.P. stack showing a further embodiment of the apparatus according to the invention disposed therein.

With reference to FIG. 7 a sleeve 35 which is rotationally fixed but axially free with block 3 by lug 37 is positioned adjacent to annular B.O.P 39 which is used to close a well but leave the drill string intact. The elements of the annular B.O.P. 39 are made of rubber and it is possible to withdraw drill pipe even with the elements 39 in the closed position.

After rams 13 impart precise orientation to block 3 and mandrel 2 the annular B.O.P. is closed and rams 13 opened. During the downward landing stroke orientation is maintained by lug 37 in sleeve 35.

After landing, the element of the annular B.O.P. 39 is opened.

FIGS. 8A and 8B show a block 60 that can be employed when the B.O.P. stack has shear type blind rams which would prevent the use of the block 3 described above. In this case the block 60 is positioned adjacent to the pipe rams to achieve precise orientation in the same manner as previously described.

The block 60 comprises two halves 62 to facilitate assembly and is externally contoured to match the contour of the particular pipe rams employed.

I claim:

1. An apparatus for installation in a handling string to orientate equipment by means of the rams of a B.O.P. stack which apparatus comprises:

an elongate member adapted to be connected in a handling string, the elongate member having a second member thereon which second member is moveable axially with respect to the elongate member and has means co-operating with corresponding means on the elongate member to prevent relative rotation, the second member also having a surface adapted for engagement with the rams of a B.O.P. stack so that when the rams of the B.O.P. stack are actuated they engage the surface of the second member and rotation of the second member relative to the B.O.P. stack is prevented.

2. An apparatus as claimed in claim 1 wherein the elongate member is a mandrel of substantially tubular form.

3. An apparatus as claimed in claim 1 wherein the means co-operating to prevent relative rotation comprises a projecting member co-operating with a recess.

4. An apparatus as claimed in claim 1 wherein the second member is a block.

5. An apparatus as claimed in claim 4 wherein the elongate member has a sleeve mounted thereon in addition to the block.

6. An apparatus as claimed in claim 1 wherein the second member is a sleeve.

7. An apparatus as claimed in claim 1 wherein the elongate member has stops to limit the axial motion of the second member.

8. A method of orientating equipment in a well involving use of the rams of a B.O.P. stack which method comprises:

i. installing in a handling string an apparatus comprising an elongate member adapted to be connected in a handling string, the elongate member having a second member thereon which second member is moveable axially with respect to the elongate member and has means co-operating with corresponding means on the elongate member to prevent relative rotation, the second member also having a surface adapted for engagement with the rams of a B.O.P. stack so that when the rams of the B.O.P. stack are actuated they engage the surface of the second member and rotation of the second member relative to the B.O.P. stack is prevented.

ii. lowering the handling string until the equipment is a small distance above a landing point and the second member is adjacent a pair of rams of the B.O.P. stack iii. closing the rams so that they engage the surface on the second member and prevent rotation thereof, and iv. lowering the handling string to land the equipment.

* * * * *